US010072657B2

(12) United States Patent
Shikano et al.

(10) Patent No.: US 10,072,657 B2
(45) Date of Patent: Sep. 11, 2018

(54) SCREW COMPRESSOR WITH AN HYDROPNEUMATIC CYLINDER INTEGRAL WITH THE BEARING HOLDER

(71) Applicant: DAIKIN INDUSTRIES, LTD., Osaka-shi, Osaka (JP)

(72) Inventors: Shigeharu Shikano, Osaka (JP); Harunori Miyamura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/548,727

(22) PCT Filed: Feb. 9, 2016

(86) PCT No.: PCT/JP2016/000653
§ 371 (c)(1),
(2) Date: Aug. 3, 2017

(87) PCT Pub. No.: WO2016/129266
PCT Pub. Date: Aug. 18, 2016

(65) Prior Publication Data

US 2018/0017058 A1 Jan. 18, 2018

(30) Foreign Application Priority Data

Feb. 10, 2015 (JP) ..... 2015-023838

(51) Int. Cl.
*F04C 18/52* (2006.01)
*F04C 27/00* (2006.01)
*F04C 28/24* (2006.01)

(52) U.S. Cl.
CPC ..... *F04C 18/52* (2013.01); *F04C 27/008* (2013.01); *F04C 28/24* (2013.01);
(Continued)

(58) Field of Classification Search
CPC ..... F04C 18/52; F04C 2240/50
See application file for complete search history.

(56) References Cited

U.S. PATENT DOCUMENTS

2013/0171018 A1* 7/2013 Inoue ..... F04C 18/52 418/191

FOREIGN PATENT DOCUMENTS

JP 2010-242656 A 10/2010
WO 2011/114636 A1 9/2011

OTHER PUBLICATIONS

International Search Report of corresponding PCT Application No. PCT/JP2016/000653 dated May 10, 2016.
(Continued)

*Primary Examiner* — Mary A Davis
(74) *Attorney, Agent, or Firm* — Global IP Counselors, LLP

(57) ABSTRACT

A screw compressor includes a casing, a drive shaft, a screw rotor, a gate rotor, a slide valve, and a slide valve driving mechanism having a hydropneumatic cylinder. The drive shaft has one end supported via a bearing on a bearing holder held by the casing. The other end is coupled to an electric motor. A compression chamber is defined by the gate rotor meshing with a helical move formed on the screw rotor. The hydropneumatic cylinder is located opposite to the screw rotor with respect to the bearing. The bearing holder has an outer peripheral surface configured as a guide surface guiding a sliding movement of the slide valve. The bearing holder has axial end portions. One of the axial end portions located opposite to the screw rotor constitutes a cylinder tube of the hydropneumatic cylinder to achieve integration of the bearing holder and the hydropneumatic cylinder.

19 Claims, 9 Drawing Sheets

(52) U.S. Cl.
CPC .... *F04C 2230/601* (2013.01); *F04C 2240/30* (2013.01); *F04C 2240/50* (2013.01); *F04C 2240/60* (2013.01)

(56) References Cited

OTHER PUBLICATIONS

International Preliminary Report of corresponding PCT Application No. PCT/JP2016/000653 dated Aug. 24, 2017.
European Search Report of corresponding EP Application No. 16 74 8912.9 dated May 25, 2018.

* cited by examiner

SCREW COMPRESSOR WITH AN HYDROPNEUMATIC CYLINDER INTEGRAL WITH THE BEARING HOLDER

CROSS-REFERENCE TO RELATED APPLICATIONS

This U.S. National stage application claims priority under 35 U.S.C. § 119(a) to Japanese Patent Application No. 2015-023838, filed in Japan on Feb. 10, 2015, the entire contents of which are hereby incorporated herein by reference.

TECHNICAL FIELD

The present invention relates to a screw compressor, and in particular, to a structure of a bearing holder configured as a member which rotatably supports a drive shaft, and guides a sliding movement of a slide valve as well.

BACKGROUND ART

Screw compressors have been used as compressors for compressing refrigerant and air. Such known screw compressors include a single-screw compressor having one screw rotor and two gate rotors.

As illustrated in FIGS. 10 and 11, a single-screw compressor (100) of this type includes a casing (110) which houses a screw rotor (140) and gate rotors (not shown). The screw rotor (140) has helical grooves (141). The gate rotors mesh with the helical grooves (141), thereby defining a compression chamber (123). Further, the casing (110) includes therein a low-pressure space (S1) and a high-pressure space (S2). When the screw rotor (140) is driven to rotate, a fluid in the low-pressure space (S1) is sucked into the compression chamber (123). After compressed in the compression chamber (123), the fluid is discharged into the high-pressure space (S2).

A drive shaft (121) is fixed to the screw rotor (140). The drive shaft (121) has one end portion (shown at left in FIGS. 10 and 11) coupled to an electric motor (not shown), and the other end portion held by a bearing holder (135) via a bearing (136). The electric motor and the bearing holder (135) are held in the casing (110). The screw rotor (140) rotates with respect to the casing (110).

The illustrated screw compressor (100) includes slide valves (170). FIG. 10 is a cross-sectional view of a portion, of the screw compressor (100), where the slide valves (70) are not provided. FIG. 11 is a cross-sectional view of a portion, of the screw compressor (100), where the slide valves (170) are provided. Each slide valve (170) is arranged with its inner surface (the surface positioned inward in the radial direction of casing (110)) facing the outer periphery of the screw rotor (140), and slidable along the outer peripheral surface of the bearing holder (135) in a direction parallel to the rotation axis of the screw rotor (140).

To drive the slide valves (170), the screw compressor (100) includes a slide valve driving mechanism (180). The slide valve driving mechanism (180) includes a cylinder tube (181) forming part of a hydraulic cylinder (hydropneumatic cylinder) (187), and a piston (182) configured to move within the cylinder tube (181) in the axial direction of the screw rotor (140). Further, the slide valve driving mechanism (180) includes coupling rods (185) coupled to the slide valves (170), and an arm (184) coupled to a piston rod (183) of the piston (182). The arm (84) is fixed to the coupling rods (185).

The screw compressor (100) illustrated in FIGS. 10 and 11 is configured such that, after the bearing holder (135) is mounted in the casing (110), a fixing plate (138) is fixed to the casing (110). The cylinder tube (181) of the slide valve driving mechanism (180) is fixed to the fixing plate (138). Although not illustrated, a single-screw compressor (100) is known in which the fixing plate (138) and the cylinder tube (181) are integrated into a single part (see Japanese Unexamined Patent Publication No. 2010-242656).

SUMMARY

Technical Problem

In the screw compressor (100) of the known art, the axial length of the bearing holder (135) is determined according to a stroke of the slide valves (170). The bearing holder (135), the fixing plate (138), and the slide valve driving mechanism (180) are the fixed to the casing (110).

Here, if the screw compressor is designed to increase an adjustable amount by lengthening the stroke of the slide valves (170), the bearing holder (135) of which the outer peripheral surface serves as a guide surface for the slide valves (170) also need to be increased in the axial length. In that case, the bearing (136) has a width (an axial length) relatively small with respect to the axial length of the bearing holder (135), and consequently, a space (139) in the bearing holder (135) is increased in the axial direction, resulting in the formation of a wasted space. Further, if the axial length of the bearing holder (135) is increased, the total length of the bearing holder (135) and the hydraulic cylinder (187) is also increased. For example, as indicated by ΔL in FIG. 10, the rear end of the hydraulic cylinder (187) is positioned far from the screw rotor (140). Consequently, a cover (not shown) covering the slide valve driving mechanism (180) and other components also need to be increased in size. As a result, the total length, the size, and the mass of the compressor (100) increase.

Conversely, in order to reduce the wasted space, it is recommended to reduce the axial length of the bearing holder (135). However, such a reduction in the axial length results in an insufficient guiding length for the slide valves (170), and a required stroke cannot be implemented.

As can be seen, there have been demands which are mutually contradictory: the stroke (the adjustable amount) of the slide valves (170) is beneficially set to be long to a certain extent; whereas the total length of the hydraulic cylinder (187) and the bearing holder (135) of which the axial length is determined according to the stroke is beneficially shortened in order to reduce the size and weight of the compressor (100).

In view of the foregoing problems, it is therefore an object of the present invention to achieve a structure in which even if a stroke of a slide valve is lengthened to increase an adjustable amount, the total length of a bearing holder (135) and a hydraulic cylinder (187) may be shortened, thereby enabling a reduction in the size and weight of a screw compressor.

Solution to the Problem

A first aspect of the present disclosure is implemented as a screw compressor including: a casing (10); a drive shaft (21) having one end supported, via a bearing (36), on a bearing holder (35) held by the casing (10), and the other end coupled to an electric motor: a screw rotor (40) coupled to the drive shaft (21); a gate rotor (50) defining a compression chamber (23) in the casing (10) by meshing with a helical groove (41) formed on the screw rotor (40); a slide valve (70) slidable in an axial direction of the screw rotor (40) and capable of regulating an area of a discharge opening of the compression chamber (23); and a slide valve driving mechanism (80) including a hydropneumatic cylinder (87) configured to drive the slide valve (70). In this screw compressor, the hydropneumatic cylinder (87) is located opposite to the screw rotor (40) with respect to the bearing (36) interposed therebetween, and the bearing holder (35) has an outer peripheral surface configured as a guide surface (37) guiding a sliding movement of the slide valve (70).

In the screw rotor, one of axial end portions of the bearing holder (35) located opposite to the screw rotor (40) constitutes a cylinder tube (81) of the hydropneumatic cylinder (87), thereby achieving integration of the bearing holder (35) and the hydropneumatic cylinder (87).

According to the first aspect, the outer peripheral surface of the bearing holder (35) with which the hydropneumatic cylinder (87) is integrated guides a sliding movement of the slide valve (70) in an axial direction. Specifically, according to the known configuration in which the bearing holder (35) and the hydropneumatic cylinder (87) are separate parts, only the outer peripheral surface of the bearing holder (35) guides a movement of the slide valve (70). By contrast, according to some aspects of the present disclosure, both the outer peripheral surface of the bearing holder (35) and the outer peripheral surface of the hydropneumatic cylinder (87) may be used as the guide surface (37). This allows the total length of the bearing holder (35) and the hydropneumatic cylinder (87) to be designed smaller than that of the kwon art.

A second aspect of the preset disclosure is an embodiment of the first aspect. In the second aspect, in the bearing holder (35), a partition plate (38) is provided to separate a bearing chamber (C1) where the bearing (36) is held, from a cylinder chamber (C2) where a piston (82) of the hydropneumatic cylinder (87) is housed, and a low-pressure communication passage (60) through which a low-pressure space (S1) provided in the casing (10) communicates with the bearing chamber (C1) extends in the casing (10) and the bearing holder (35).

According to the second aspect, since the bearing chamber (C1) and the low-pressure space (S1) of the casing (10) communicate with each other through the low-pressure communication passage (60), the bearing chamber (C1) may be constantly kept at a low pressure. As a result, a pressure on the suction side of the screw rotor (40) (a low pressure) becomes as low as a pressure in the bearing chamber (C1), and a thrust load applied on the bearing (36) may be reduced.

A third aspect of the present disclosure is an embodiment of the first or second aspect. In the third aspect, the bearing holder (35) has, on an outer periphery of an end portion thereof close to the cylinder tube (81), a fixing portion (39) which projects radially outwardly and via which the bearing holder (35) is fixed to the casing (10), and a shim plate (95) for adjusting an axial position of the bearing holder (35) is fitted between the fixing portion (39) and the casing (10).

According to the third aspect, the shim plate (95) may be used to adjust the position of the bearing holder (35), which also enables adjustment of the position of the screw rotor (40) that is adjacent to the bearing holder (35).

A fourth aspect of the present disclosure is an embodiment of the third aspect. In the fourth aspect, the shim plate (95) is comprised of an arc-shaped shim plate (95*a*) which is one of multiple pieces prepared by dividing, in a circumferential direction, a ring-shaped position adjusting member fitting on the outer periphery of the bearing holder (35).

According to the fourth aspect, a plurality of arc-shaped shim plates (95) may be easily fitted, radially inwardly, between the fixing portion (39) of the bearing holder (35) and the casing (10).

A fifth aspect of the present disclosure is an embodiment of the third or fourth aspect. In the fifth aspect, an oil supply passage (65) through which hydraulic oil is supplied to the hydropneumatic cylinder (87) extends from a portion of the casing (10) to a portion of the fixing portion (39), and the oil supply passage (65) is provided with a passage connecting member (68) which has a tube shape and is fitted to the casing (10) and the fixing portion (39) at a boundary between the casing (10) and the fixing portion (39).

According to the fifth aspect, the oil supply passage (65) may be connected easily and reliably at the boundary between the casing (10) and the fixing portion (39) by using the passage connecting member (68).

A sixth aspect of the present invention is an embodiment of the fifth aspect. In the sixth aspect, an O-ring (69) is fitted between the passage connecting member (68) and the casing (10), and another O-ring (69) is fitted between the passage connecting member (68) and the fixing portion (39).

According to the sixth aspect, the O-rings (69) may reliably prevent the oil from leaking between the passage connecting member (68) and the casing (10) and between the passage connecting member (68) and the fixing portion (39).

A seventh aspect of the present disclosure is an embodiment of the fifth or sixth aspect. In the seventh aspect, part of the oil supply passage (65) extends in an end plate (88) which is provided as a member for blocking an opening end, of the bearing holder (35), close to the cylinder tube (81).

According to the seventh aspect, the oil may be supplied to the cylinder chamber (C2) via the end plate (88).

Advantages of the Invention

According to the first aspect of the present disclosure, one axial end portion of the bearing holder (35) constitutes the cylinder tube (81) of the hydropneumatic cylinder (87), thereby achieving integration of the bearing holder (35) and the hydraulic cylinder (87). Thus, if the bearing holder (35) and the hydropneumatic cylinder (87) were configured as separate parts, the separate hydropneumatic cylinder (87) would be mounted to the bearing holder (35) having an axial length corresponding to the stroke of the slide valve (70), which would result in an increase in the total length. By contrast, according to this aspect, the integration of the bearing holder (35) and the hydropneumatic cylinder (87) eliminates the need for mounting the separate hydropneumatic cylinder (87) to the bearing holder (35). Further, the portion constituting the cylinder tube (81) of the hydropneumatic cylinder (87) may also be used as the guide surface (37) for the sliding movement of the slide valve (70). This enables the total length of the portion constituted by the bearing holder (35) and the hydropneumatic cylinder (87) to be designed smaller than that of the known structure, even if the stroke of the slide valve (70) is lengthened. As a result, the total length of the screw compressor may be reduced, which enables a decrease not only in the size and weight of the screw compressor, but also in the wasted space in the bearing holder. In particular, in the case of a large screw compressor, a decrease in the total length and the resultant decrease in the weight lead to a significant decrease in the amount of materials to be used, and consequently, a significant reduction in the costs. In general, the bearing holder (35) and the cylinder tube (81) are each made of a casting. If these were separate parts, the number of the separate casting parts and the costs would increase. By contrast, according to this aspect, these parts are integrated into a single part, which also contributes to the reduction in the costs.

According to the second aspect of the present disclosure, provision of the low-pressure communication passage (60) through which the bearing chamber (C1) and the low-pressure space (S1) of the casing (10) communicate with each other allows the bearing chamber (C1) to be constantly kept at a low pressure, and a thrust load applied to the bearing (36) is reduced. This may retard damage to the bearing (36).

According to the third aspect of the present disclosure, the shim plates (95) are used to adjust the position of the bearing holder (35), which also enables adjustment of the position of the screw rotor (40) that is adjacent to the bearing holder (35). As a result, reliable positioning of the screw rotor (40) that is adjacent to the bearing holder (35) may be achieved with respect to the gate rotors (50). That is to say, in the configuration in which the cylinder tube (81) is integral with the bearing holder (35), a structure for adjusting the position of the screw rotor (40) may be achieved easily.

According to the fourth aspect of the present disclosure, a plurality of arc-shaped shim plates (95) may be fitted, radially inwardly, between the fixing portion (39) of the bearing holder (35) and the casing (10). This may facilitate positioning of the bearing holder (35) and the screw rotor (40) when the bearing holder (35) and the screw rotor (40) are mounted in the casing (10).

According to the fifth aspect of the present disclosure, the oil supply passage (65) may be connected easily and reliably at the boundary between the casing (10) and the fixing portion (39) with the passage forming member (68). That is to say, in the configuration in which the cylinder tube (81) is integral with the bearing holder (35), the oil supply passage (65) may be provided with a simple configuration.

According to the sixth aspect of the present disclosure, the O-rings (69) may reliably prevent the oil from leaking between the passage connecting member (68) and the casing (10) and between the passage connecting member (68) and the fixing portion (39).

According to the seventh aspect, a configuration for supplying the oil to the cylinder chamber (C2) may be put to practical use, using the end plate (88).

BRIEF DESCRIPTION OF THE DRAWINGS

FIG. 9A illustrates a suction process, FIG. 9B illustrates a compression process, and FIG. 9C illustrates a discharge process.

DESCRIPTION OF EMBODIMENTS

An Embodiment of the present invention will be described in detail below, with reference to the drawings.

<<Embodiment of Invention>>

The embodiment of the present invention is now described.

Figure 1:
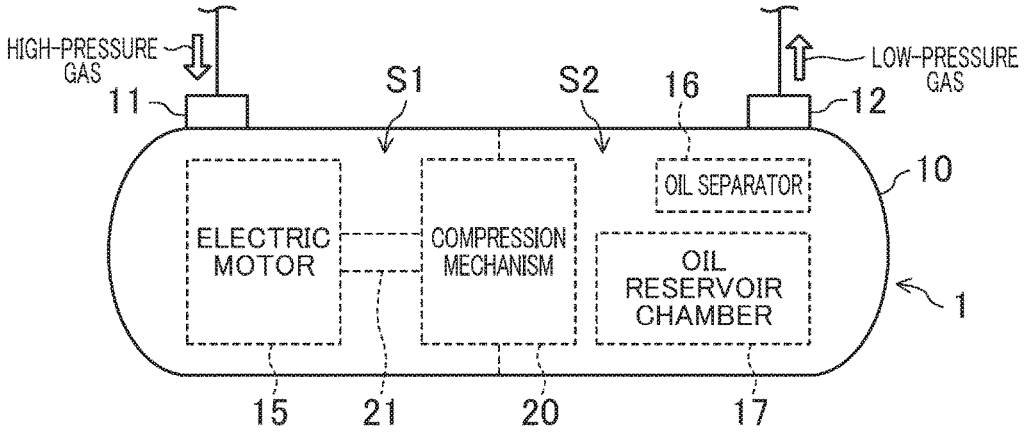
FIG. 1 is a schematic view illustrating an overall configuration of a screw compressor according to an embodiment of the present invention.

As illustrated in FIG. 1, a screw compressor (1) of this embodiment includes a compression mechanism (20) and an electric motor (15) configured to drive the compression mechanism (20) which are housed in a single casing (10). The screw compressor (1) is configured as a semi-hermetic compressor.

The casing (10) has a horizontally oriented cylindrical shape. The inner space of the casing (10) is partitioned into a low-pressure space (S1) located close to one end of the casing (10) and a high-pressure space (S2) located close to the other end of the casing (10). The casing (10) is provided with a suction pipe-connecting portion (11) communicating with the low-pressure space (S1), and a discharge pipe-connecting portion (12) communicating with the high-pressure space (S2). A low-pressure gas refrigerant from an evaporator of a refrigerant circuit included in a refrigerating apparatus such as a chiller system (not shown) passes through the suction pipe-connecting portion (11) and enters the low-pressure space (S1). A compressed high-pressure gas refrigerant which has been discharged from the compression mechanism (20) into the high-pressure space (S2) passes through the discharge pipe-connecting portion (12), and then, is supplied to a condenser of the refrigerant circuit.

In the casing (10), the electric motor (15) is arranged in the low-pressure space (S1), and the compression mechanism (20) is arranged between the low-pressure space (S1) and the high-pressure space (S2). The compression mechanism (20) has a drive shaft (21) coupled to the electric motor (15). The electric motor (15) of the screw compressor (1) is connected to a commercial power supply (not shown). The electric motor (15) is supplied with AC power from the commercial power supply, and rotates at a constant rotational speed.

In the casing (10), an oil separator (16) is arranged in the high-pressure space (S2). The oil separator (16) separates refrigerating machine oil from the refrigerant discharged from the compression mechanism (20). In the high-pressure space (S2), an oil reservoir chamber (17) is provided below the oil separator (16). The refrigerating machine oil, which serves as lubricating oil, is accumulated in the oil reservoir chamber (17). The refrigerating machine oil separated from the refrigerant by the oil separator (16) flows downward to be accumulated in the oil reservoir chamber (17).

Figure 2:
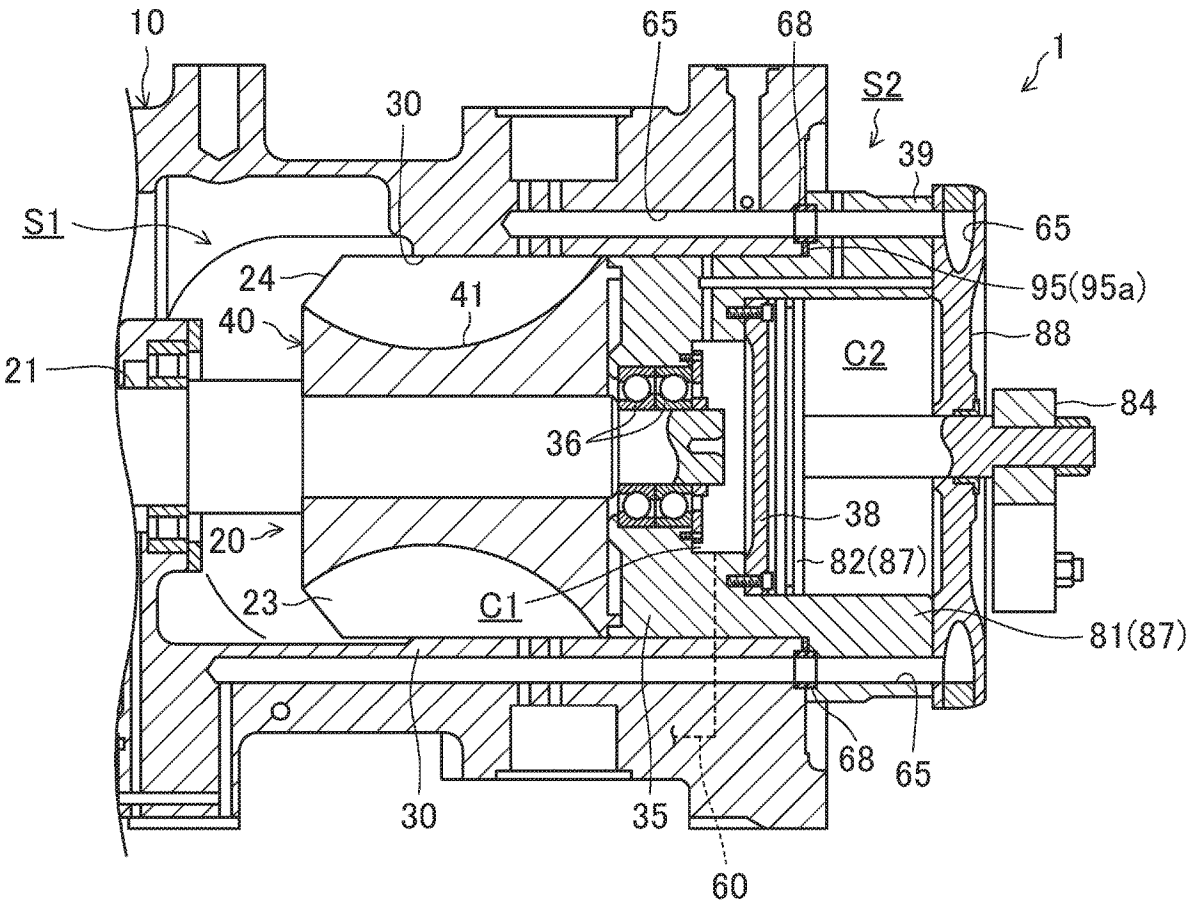
FIG. 2 is a first cross-sectional view of a portion, of a screw compressor, where slide valves are not provided, taken in an axial direction.
Figure 3:
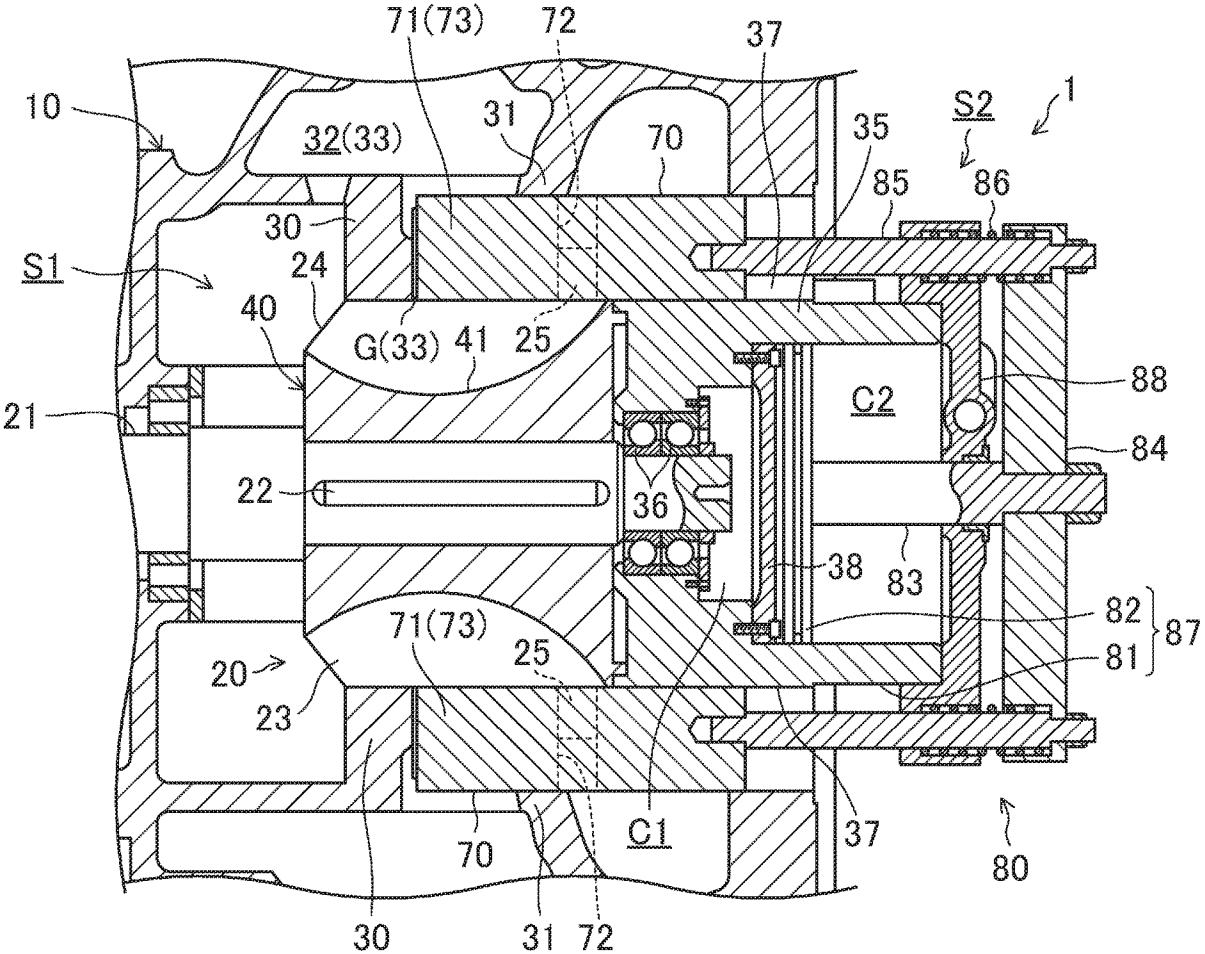
FIG. 3 is a second cross-sectional view of a portion, of the screw compressor, where the slide valves are provided, taken in the axial direction.
Figure 4:
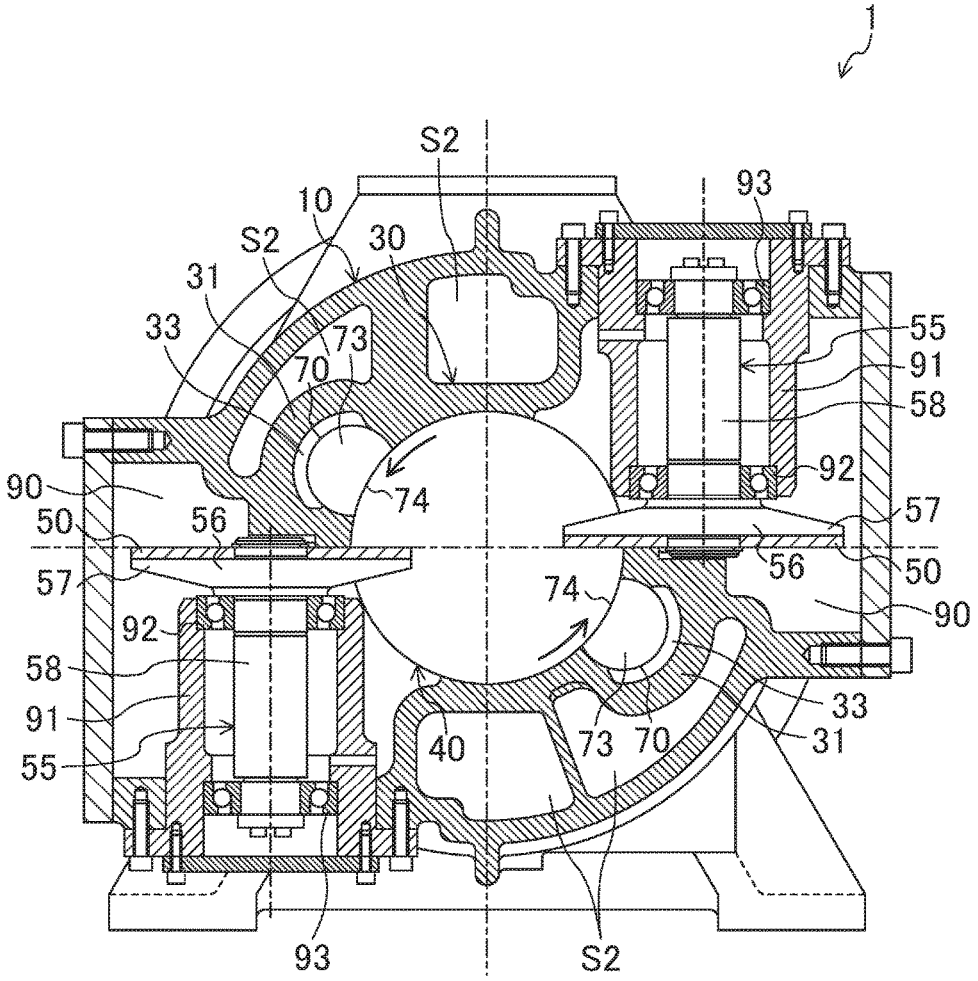
FIG. 4 is a cross-sectional view of the screw compressor, taken plane orthogonal to the axis.

As illustrated FIGS. 2-4, the compression mechanism (20) includes a cylindrical wall (30) formed in the casing (10), one screw rotor (40) arranged in the cylindrical wall (30), and two gate rotors (50) meshing with the screw rotor (40). The drive shaft (21) penetrates the screw rotor (40), and the screw rotor (40) and the drive shaft (21) is coupled to each other with a key (22). The drive shaft (21) is arranged coaxially with the screw rotor (40). The screw rotor (40) is driven and rotated in the casing (10), by the electric motor (15) arranged on a suction side of the screw rotor (40). The drive shaft (21) has one end supported, via a bearing (36), on a bearing holder (35) held by the casing (10), and the other end coupled to the electric motor (15).

A portion, of the bearing holder (35), shown at left in the figures is inserted in an end portion, of the cylindrical wall (30), located close to the high-pressure space (S2). The portion, of the bearing holder (35), inserted in the cylindrical wall (30) has a generally cylindrical shape. The portion, of the bearing holder (35), inserted in the cylindrical wall (30) has an outside diameter which is substantially equal to a diameter defined by an inner peripheral surface of the cylindrical wall (30) (i.e., a surface being in sliding contact with an outer peripheral surface of the screw rotor (40)). An outer peripheral surface of the portion, of the bearing holder (35), inserted in the cylindrical wall (30) is configured to come into sliding contact with slide valves (70), which will be described later, and functions as a sliding contact surface (guide surface) (37) to guide a sliding movement of the slide valves (70). A tip end portion of the drive shaft (21) penetrates the bearing (36) provided inside the bearing holder (35). The bearing (36) supports the drive shaft (21) in a rotatable manner. A hydraulic cylinder (87) of a slide valve driving mechanism (80), which will be described later, has a cylinder tube (81) which is integral with the bearing holder (35).

Figure 5:
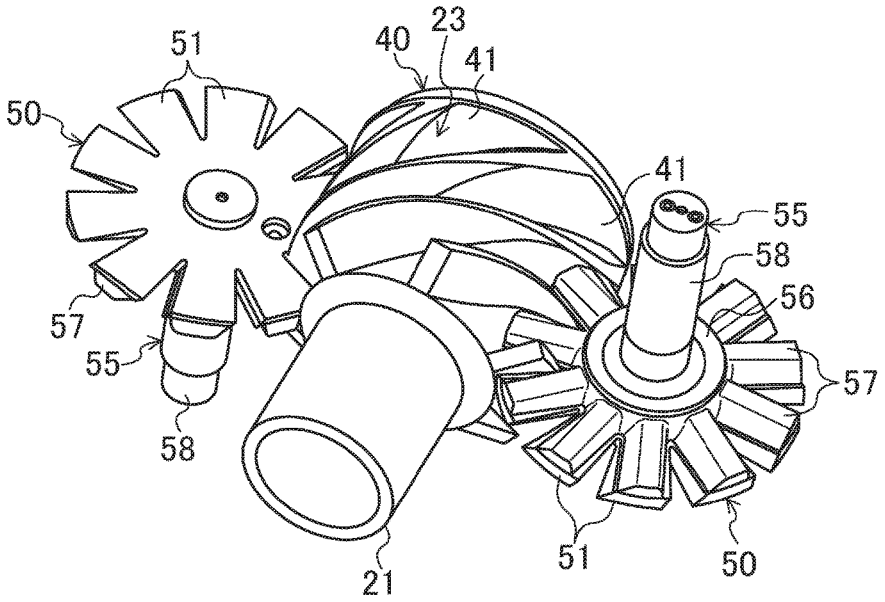
FIG. 5 is a perspective view of main portions extracted from the screw compressor.

The screw rotor (40) illustrated in FIG. 5 is a metal member having a generally cylindrical shape. The screw rotor (40) is rotatably fitted in the cylindrical wall (30), and its outer peripheral surface is in sliding contact with the inner peripheral surface of the cylindrical wall (30) via an oil film. The screw rotor (40) has, on its outer peripheral portion, a plurality of helical grooves (41) (six grooves in this embodiment) helically extending from one end toward the other end of the screw rotor (40).

In FIG. 5, each of the helical grooves (41) of the screw rotor (40) has its starting end facing the viewer, and its terminal end facing away from the viewer. An end portion, of the screw rotor (40), facing the viewer in the figure (i.e., the end portion close to the suction side) is tapered. In the screw rotor (40) illustrated in FIG. 5, the starting ends of the helical grooves (41) open at the end face of the tapered portion facing the viewer. The terminal ends of the helical grooves (41) do not open at the other end facing away from the viewer.

Each gate rotor (50) is a resin member. Each gate rotor (50) has a plurality of gates (51) (eleven gates in this embodiment) having a rectangular plate shape and arranged radially. The gate rotors (50) are arranged outside the cylindrical wall (30) and axisymmetrically with respect to the rotational axis of the screw rotor (40). The center axis of each gate rotor (50) is in a plane orthogonal to the center axis of the screw rotor (40). Each gate rotor (50) is arranged such that the gates (51) penetrate a portion of the cylindrical wall (30) and mesh with the helical grooves (41) to define a compression chamber (23) in the casing (10).

The gate rotors (50) are each attached to a rotor support member (55) made of metal (see FIG. 5). The rotor support member (55) includes a base (56), arms (57), and a shaft (58). The base (56) has a relatively thick disc shape. The arms (57) are provided in the same number as the gates (51) of the gate rotor (50), and extend radially outwardly from the outer peripheral surface of the base (56). The shaft (58) has a rod shape and stands on the base (56). The center axis of the shaft (58) coincides with the center axis of the base (56). The gate rotor (50) is attached to the surfaces of the base (56) and the arms (57), opposite to the shaft (58). The arms (57) are in contact with the backsides of the gates (51).

The rotor support members (55) each having the gate rotor (50) attached thereto are arranged in gate rotor chambers (90) which are adjacent to the cylindrical wall (30) and defined in the casing (10) (see FIG. 4). The rotor support member (55) shown on the right of the screw rotor (40) in FIG. 4 is oriented such that the gate rotor (50) faces downward. On the other hand, the other rotor support member (55) shown on the left of the screw rotor (40) in FIG. 4 is oriented such that the gate rotor (50) faces upward. The shaft (58) of each rotor support member (55) is rotatably supported, via bearings (92, 93), in a bearing housing (91) in the gate rotor chamber (90) Note that the gate rotor chambers (90) communicate with the low-pressure space (S1).

In the compression mechanism (20), the inner peripheral surface of the cylindrical wall (30), the helical grooves (41) of the screw rotor (40), and the gates (51) of the gate rotors (50) surround the compression chamber (23). Each helical groove (41) of the screw rotor (40) opens, at its suction side end, to the low-pressure space (S1), and this open portion functions as a suction port (24) of the compression mechanism (20).

The screw compressor (1) includes slide valves (70) which constitute an unload mechanism. The unload mechanism performs an unload operation for adjusting an operation capacity by returning part of gas which is in process of compression to the low pressure side. The slide valves (70) are arranged in slide valve housing portions (31). As illustrated in FIG. 4, the slide valve housing portions (31) correspond to two peripheral portions of the cylindrical wall (30) protruding radially outwardly. The slide valves (70) are slidable in the center axis direction of the cylindrical wall (30), and face the outer peripheral surface of the screw rotor (40) when the slide valves (70) have been inserted in the slide valve housing portions (31). The specific structure of each slide valve (70) will be described later. For each slide valve (70), an end of movement toward the discharge side in FIG. 3 (the right side in the figure) corresponds to an end of movement on a full open side, and an end of movement toward the suction side corresponds to an end of movement on a full close side.

In the casing (10), communication passages (32) are formed outside the cylindrical wall (30). The communication passages (32) correspond to the slide valve housing portions (31) on a one-by-one basis. Each communication passage (32) has one end opening into the low-pressure space (S1) and the other end opening at the suction side end of the associated slide valve housing portion (31).

When the slide valves (70) slide toward the high-pressure space (S2) (i.e., rightward when the axial direction of the drive shaft (21) in FIG. 3 is regarded as the lateral direction), axial gaps (G) are formed between end faces of the slide valve housing portions (31) and an end face of bypass opening degree regulation portions (71) of the slide valves (70). Each axial gap (G) forms, together with the associated communication passage (32), a bypass passage (33) through which the refrigerant is returned to the low-pressure space (S1) from an in-progress compression point of the compression chamber (23). That is to say, the bypass passage (33) has one end communicating with the low-pressure space (S1) corresponding to the suction side of the compression chamber (23), and the other end openable at the inner peripheral surface of the cylindrical wall (30) corresponding to the in-progress compression point of the compression chamber (23). When the slide valves (70) are moved to vary the degree of opening of the bypass passages (33), a flow rate at which the refrigerant returns from the in-progress compression point to the low pressure side varies. As a result, the capacity of the compression mechanism (20) varies.

Each slide valve (70) includes the bypass opening degree regulation portion (71) for regulating the degree of opening of the bypass passage (33), and a discharge opening regulation portion (72) for regulating the area of an opening of the discharge port (25) which is formed in the cylindrical wall (30) so as to cause the compression chamber (23) to communicate with the high-pressure space (S2). The slide valves (70) are slidable in the axial direction of the screw rotor (40). The discharge opening regulation portion (72) of the slide valve (70) is configured to vary the area of the opening of the discharge port (25) in accordance with changes of the position of the slide valve (70).

The screw compressor (1) includes the slide valve driving mechanism (80) configured to regulate the degree of opening of the bypass passages (33) by driving and sliding the slide valves (70). The slide valves (70) and the slide valve driving mechanism (80) constitute the unload mechanism (70, 80). The slide valve driving mechanism (80) includes the cylinder tube (81), a piston (82) fitted in the cylinder tube (81), an arm (84) coupled to a piston rod (83) of the piston (82), coupling rods (85) coupling the arm (84) to the slide valves (70), and springs (86) biasing the arm (84) rightward in FIG. 3 (i.e., in the direction in which arm (84) moves away from the casing (10)). The cylinder tube (81) and the piston (82) are components forming a hydraulic cylinder (hydropneumatic cylinder) (87). In this embodiment, out of both axial end portions of the bearing holder (35), one located opposite to the screw rotor (40) is configured as the cylinder tube (81). The hydraulic cylinder (87) is located opposite to the screw rotor (40) with respect to the bearing (36) interposed therebetween, and the bearing holder (35) is integral with the hydraulic cylinder (87).

In the bearing holder (35), a partition plate (38) is provided to separate a bearing chamber (C1) where the bearing (36) is held, from a cylinder chamber (C2) where the piston (82) of the hydraulic cylinder (87) is housed. A low-pressure communication passage (60) through which the low-pressure space (S1) in the casing (10) communicates with the bearing chamber (C1) extends in the casing (10) and the bearing holder (35) (FIG. 2).

In the slide valve driving mechanism (80) of FIG. 3, in the state illustrated in FIG. 3, a space located on the left of the piston (82) in the cylinder chamber (C2) (i.e., the space located close to the screw rotor (40) with respect to the piton (82)) has a higher internal pressure than a space located on the right of the piston (82) (i.e., the space located close to the arm (84) with respect to the piton (82)). The slide valve driving mechanism (80) is configured to adjust the position of the slide valves (70) by regulating the inner pressure of the space located on the right of the piston (82) (i.e., the gas pressure in the right space). For this reason, a passage (not shown) for regulating the pressure in the right space extends in the bearing holder (35).

While the screw compressor (1) is in operation, a suction pressure of the compression mechanism (20) acts on one of the axial end faces of each slide valve (70) (i.e., the end face of the bypass opening degree regulation portion (71)), and a discharge pressure of the compression mechanism (20) acts on the other of the axial end faces of each slide valve (70). Consequently, while the screw compressor (1) is in operation, a force pushing the slide valves (70) toward the low-pressure space (S1) constantly acts on the slide valves (70). Therefore, if the inner pressures of the spaces located on the left and right of the piston (82) in the slide valve driving mechanism (80) are varied, the magnitude of a force pulling back the slide valves (70) toward the high-pressure space (S2) varies, resulting in a change of the position of the slide valves (70).

As illustrated in FIG. 2, the bearing holder (35) has, on the outer periphery of an end portion thereof close to the cylinder tube (81), a fixing portion (39) which projects radially outwardly and via which the bearing holder (35) is fixed to the casing (10) with a fastening member such as a bolt (not shown). Shim plates (95) for adjusting the axial position of the bearing holder (35) are fitted between the fixing portion (39) and the casing (10).

Each of the shim plates (95) is comprised of an arc-shaped shim plate (95*a*) which is one of multiple pieces prepared by dividing, in a circumferential direction, a ring-shaped shim fitting on the outer periphery of the bearing holder (35). Fitting the arc-shaped shim plates (95*a*), which are prepared by divided the ring-shaped shim in the circumferential direction, between the fixing portion (39) and the casing (10) such that the shim plates (95*a*) are at positions corresponding to the fixing portion (39) (i.e., positions where the slide valves (70) are not provided) allows adjustment of the axial position of the bearing holder (35).

Figure 6:
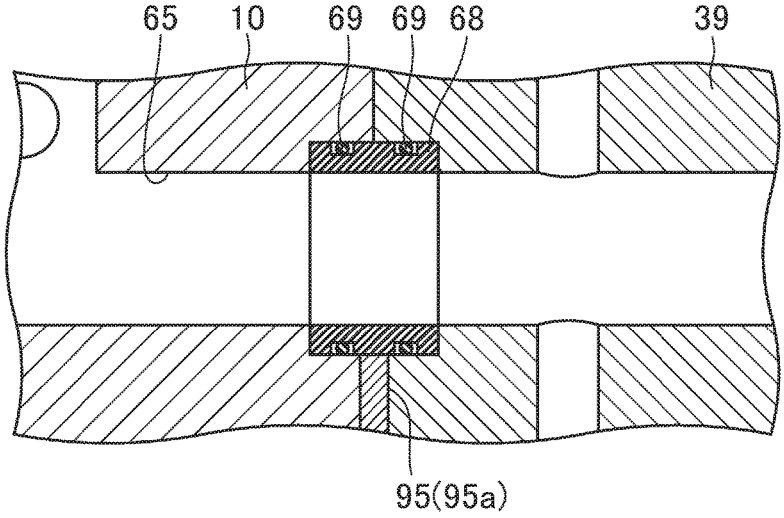
FIG. 6 illustrates, on an enlarged scale, a portion of FIG. 2.

In the screw compressor (1), an oil supply passage (65) through which a hydraulic oil is supplied to the hydraulic cylinder (87) extends from a portion of the casing (10) to a portion of the fixing portion (39). As illustrated on an enlarged scale in FIG. 6, the oil supply passage (65) is provided with a passage connecting member (68) which has a tube shape and is fitted to the casing (10) and the fixing portion (39) at the boundary between the casing (10) and the fixing portion (39). An O-ring is fitted between the passage connecting member (68) and the casing (10). Another O-ring is fitted between the oil supply passage (68) and the fixing portion (39). These O-rings are intended to prevent the oil from leaking from the boundary surface between the casing (10) and the fixing portion (39). In the screw compressor (1), an end plate (88) is provided as a member for blocking an opening end, of the bearing holder (35), close to the cylinder tube (81), and part of the oil supply passage (65) extends in the end plate (88).

Figure 7:
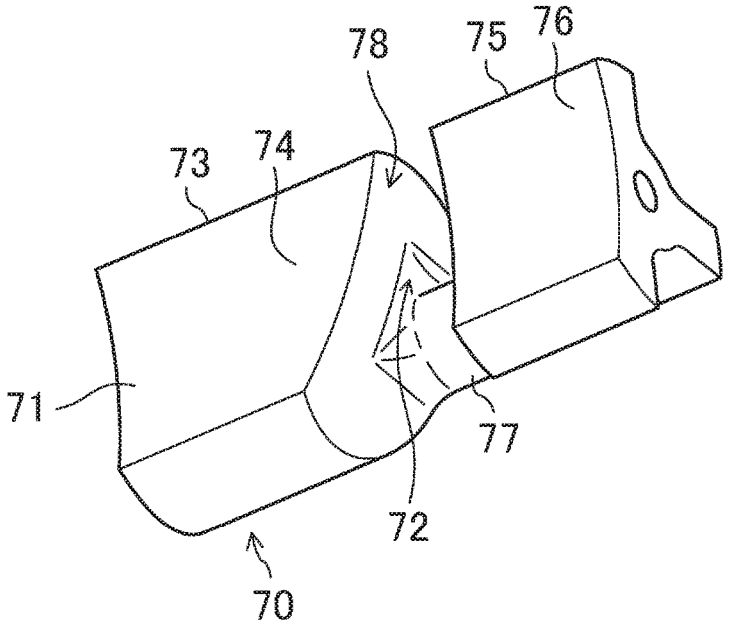
FIG. 7 is a perspective view of the slide valve.
Figure 8:
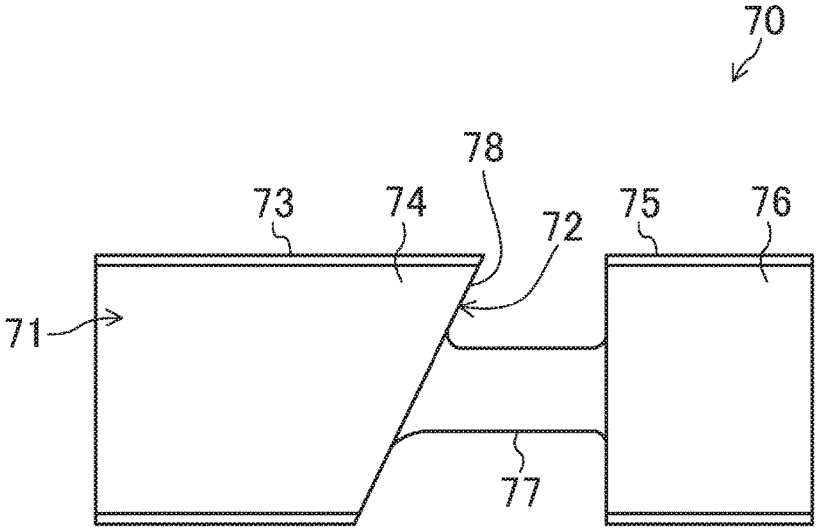
FIG. 8 is a front view of the slide valve.

The slide valve (70) is now described in detail with reference to FIGS. 7 and 8.

The slide valve (70) is comprised of a valve body portion (73), a guide portion (75), and a coupling portion (77). In the slide valve (70), the valve body portion (73), the guide portion (75), and the coupling portion (77) are made of a single metal member. In other words, the valve body portion (73), the guide portion (75), and the coupling portion (77) are integral with one another.

As illustrated also in FIG. 4, the valve body portion (73) has a shape like a solid cylindrical column with a portion chipped away therefrom. The valve body portion (73) is arranged and oriented in the casing (10) such that its chipped surface (an inner surface portion: a portion positioned inward in the radial direction of the casing) faces the screw rotor (40). The valve body portion (73) has a sliding contact surface (74) facing the screw rotor (40). The sliding contact surface (74) is an arc surface having a radius of curvature equal to that of the inner peripheral surface of the cylindrical wall (30), and extends in an axial direction of the valve body portion (73). The sliding contact surface (74) of the valve body portion (73) comes into sliding contact with the screw rotor (40) via an oil film, and faces the compression chamber (23) defined by the helical grooves (41).

The valve body portion (73) has one end face (the left end face in FIG. 3) is a flat surface which is orthogonal to the center axis of the valve body portion (73). This end face is the end face of the bypass opening degree regulation portion (71), and also is the forward end face of the slide valve (70) in the direction in which the slide valve (70) slides. The valve body portion (73) has the other end face (the right end face in FIG. 7) constituting an inclined surface (78) which is inclined with respect to a plane orthogonal to the axis of the valve body portion (73). The inclined surface (78) of the valve body portion (73) is inclined in the same direction as that in which the helical grooves (41) of the screw rotor (40) are twisted.

The guide portion (75) has the shape of a column with a T-shaped cross section. The guide portion (75) has a side surface which corresponds to the horizontal bar of the T-shape (i.e., the side surface facing the viewer in FIG. 7) and which is an arc surface having a radius of curvature equal to that of the inner peripheral surface of the cylindrical wall (30). This side surface constitutes a sliding contact surface (76) which is in sliding contact with the outer peripheral surface of the bearing holder (35) via an oil film. In other words, the sliding contact surface (76) is in sliding contact with the guide surface (37) of the bearing holder (35). In the slide valve (70), the guide portion (75) is spaced from the end face (inclined surface) (78) of the valve body portion (73), and oriented such that the sliding contact surface (76) of the guide portion (75) faces in the same direction as the sliding contact surface (74) of the valve body portion (73).

The coupling portion (77) has the shape of a relatively short column, and couples the valve body portion (73) to the guide portion (75). The coupling portion (77) is positioned off-set, away from the sliding contact surface (74) of the valve body portion (73) and the sliding contact surface (76) of the guide portion (75). In the slide valve (70), a space between the valve body portion (73) and the guide portion (75) and a space located close to the backside (i.e., the side opposite to the sliding contact surface (76)) of the guide portion (75) together form a passage for a discharged gas. A space between the sliding contact surface (74) of the valve body portion (73) and the sliding contact surface (76) of the guide portion (75) constitutes the discharge opening regulation portion (72) for regulating the area of the opening of the discharge port (25).

-Operation-

Figure 9A:
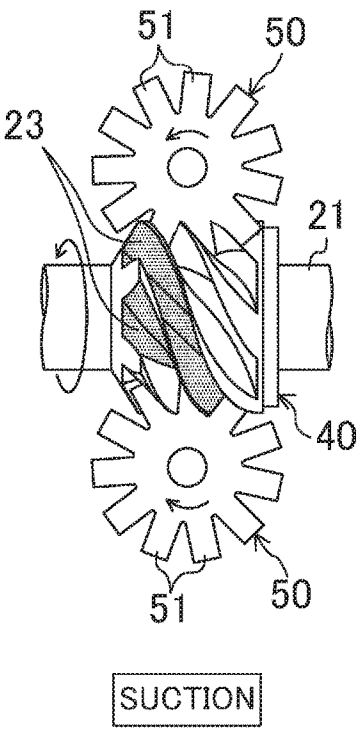
FIGS. 9A-9C are plan views illustrating an operation of a compression mechanism of the screw compressor.
Figure 9B:
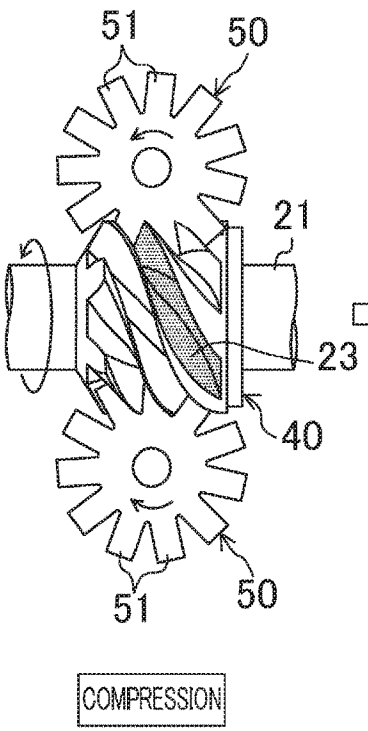
Figure 9C:
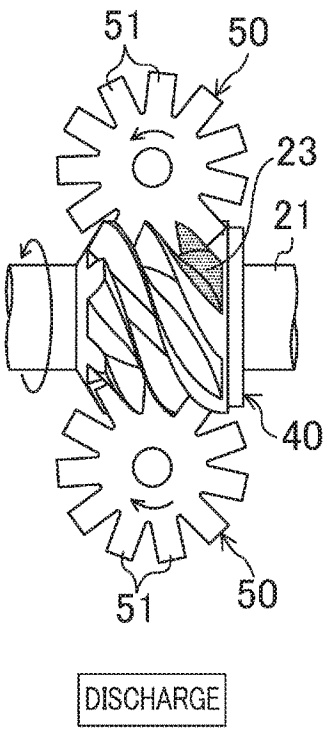
Figure 10:
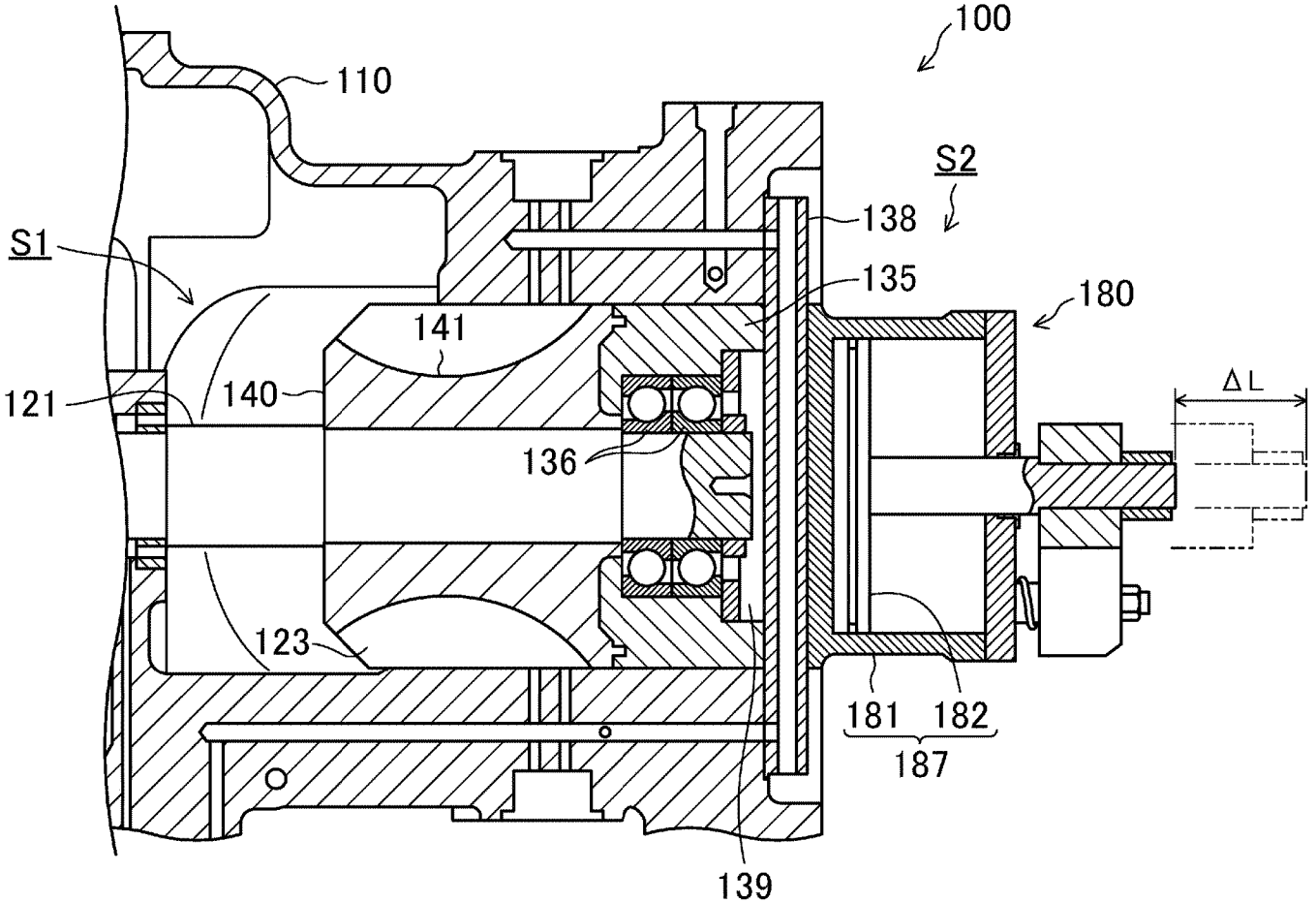
FIG.10 (PRIOR ART)
FIG. 10 is a first cross-sectional view of a portion, of a known screw compressor, where slide valves are not provided, taken in an axial direction.
Figure 11:
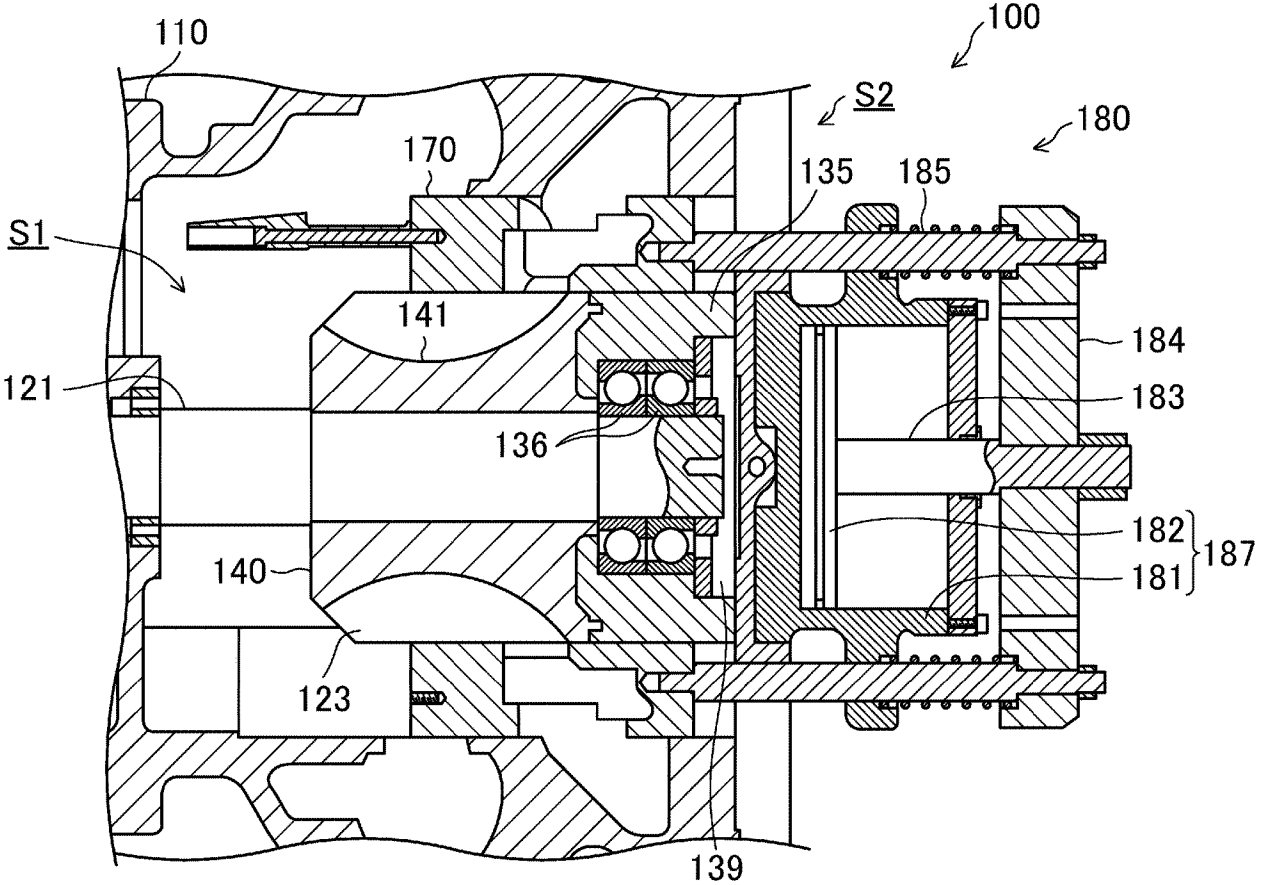
FIG.11 (PRIOR ART)
FIG. 11 is a second cross-sectional view of a portion, of the known screw

It is now described an overall operation of the screw compressor (1) with reference to FIGS. 9A-9C.

In the screw compressor (1), upon actuation of the electric motor (15), the screw rotor (40) is rotated in conjunction with the rotation of the drive shaft (21). The gate rotors (50) are also rotated in conjunction with the rotation of the screw rotor (40), thereby causing the compression mechanism (20) to repeatedly perform a suction process, a compression process, and a discharge process. Here, the operation of the screw compressor (1) is described, focusing on the compression chamber (23) marked with dots in FIGS. 9A-9C.

In FIG. 9A, the compression chamber (23) marked with dots communicates with the low-pressure space (S1). The helical groove (41) defining the compression chamber (23) meshes with a gate (51) of the gate rotor (50) shown in a lower part of the figure. When the screw rotor (40) rotates, the gates (51) relatively moves toward the terminal end of the helical groove (41), causing the capacity of the compression chamber (23) to increase. As a result, the low-pressure gas refrigerant in the low-pressure space (S1) is sucked into the compression chamber (23) through the suction port (24).

When the screw rotor (40) rotates further, the compression mechanism enters state illustrated in FIG. 9B. In FIG. 9B, the compression chamber (23) marked with dots is fully closed. Specifically, the helical groove (41) defining the compression chamber (23) meshes with a gate (51) of the gate rotor (50) shown in an upper part of the figure, and this gate (51) separates the compression chamber (23) from the low-pressure space (S1). As the gate (51) moves toward the terminal end of the helical groove (41) in conjunction with the rotation of the screw rotor (40), the capacity of the compression chamber (23) decreases gradually. As a result, the gas refrigerant in the compression chamber (23) is compressed.

When the screw rotor (40) rotates further, the compression mechanism enters state illustrated in FIG. 9C. In FIG. 9C, the compression chamber (23) marked with dots communicates with the high-pressure space (S2) through the discharge port (25). When the gate (51) moves toward the terminal end of the helical groove (41) in conjunction with the rotation of the screw rotor (40), the compressed gas refrigerant is pushed out of the compression chamber (23) into the high-pressure space (S2).

It is described next how the capacity of the compression mechanism (20) is controlled using the slide valves (70), with reference to FIG. 3. Note that the capacity of the compression mechanism (20) means "an amount of refrigerant passing through an evaporator and sucked into the compressor (1) via the suction pipe-connecting portion (11) per unit time." The capacity of the compression mechanism (20) has the same meaning as the operation capacity of the screw compressor (1).

When pressed leftward as much as possible in FIG. 3, each slide valve (70) is at the end of movement on the full close side (the suction side). The forward end face of the slide valve (70) closes the axial gap (G), and the capacity of the compression mechanism (20) is maximized. Specifically, in this state, the bypass passage (33) is fully closed by the valve body portion (73) of the slide valve (70), and all of the gas refrigerant which has been sucked from the low-pressure space (S1) into the compression chamber (23) is discharged to the high-pressure space (S2) through the discharge port (25). Thus, in this state, the operation capacity of the screw compressor (1) is maximized.

On the other hand, when each slide valve (70) is retracted rightward in FIG. 3 and the forward end face of the slide valve (70) opens the axial gaps (G), the bypass passage (33) opens at the inner peripheral surface of the cylindrical wall (30). In this state, part of the gas refrigerant that has been sucked from the low-pressure space (S1) into the compression chamber (23) leaves the compression chamber (23) in which the compression process is in progress, passes through the bypass passage (33), and returns to the low-pressure space (S1). The rest of the gas refrigerant is compressed completely, and then, discharged into the high-pressure space (S2). In this state, the sliding contact surface (76) of each slide valve (70) is in sliding contact with the guide surface (37) of the bearing holder (35), with which the cylinder tube (81) of the hydraulic cylinder (87) is integrated.

As the axial gap (G) is widened further (i.e., as the area of the opening of the bypass passage (33) at the inner peripheral surface of the cylindrical wall (30) is increased), the amount of refrigerant returning to the low-pressure space (S1) through the bypass passage (33) increases, whereas the amount of refrigerant discharged into the high-pressure space (S2) decreases. Further, as the axial gap (G) is widened, a flow rate at which the refrigerant is sucked into the compressor (1) from suction pipe of the refrigerant circuit decreases, and the capacity of the compression mechanism (20) decreases.

When the slide valve (70) is positioned at the end of movement on the full open side (the discharge side), the distance between the forward end face of the slide valve (70) and the end face of the cylindrical wall (30) (i.e., the end face of the slide valve housing portion (31)) is maximized. In other words, in this state, the area of the opening of the bypass passage (33) at the inner peripheral surface cylindrical wall (30) is maximized, resulting in maximization of a flow rate at which the bypass gas refrigerant is returned from the compression chamber (23) to the low-pressure space (S1) through the bypass passage (33). Thus, in this state, a flow rate at which the refrigerant is discharged from the compression mechanism (20) into the high-pressure space (S2) is minimized. When a flow rate of bypass gas refrigerant is maximized, a flow rate at which the refrigerant is sucked from the suction pipe of the refrigerant circuit into the compressor (1) is minimized, and the operation capacity of the screw compressor (1) is minimized.

Note that the refrigerant which is discharged from the compression chamber (23) toward the high-pressure space (S2) first flows into the discharge port (25) formed in the slide valve (70) after leaving the compression chamber (23). Thereafter, the refrigerant passes through the discharge opening regulation portion (72), flows through the passage close to the backside of the guide portion (75) of the slide valve (70), and enters the high-pressure space (S2).

-Advantages of Embodiment-

According to this embodiment, one axial end portion of the bearing holder (35) constitutes the cylinder tube (81) of the hydraulic cylinder (87), thereby achieving integration of the bearing holder (35) and the hydraulic cylinder (87). Thus, if the bearing holder (35) and the hydraulic cylinder (87) were configured as separate parts, the separate hydraulic cylinder (87) would be mounted to the bearing holder (35) having an axial length corresponding to the stroke of the slide valve (70), which would result in an increase in the total length. By contrast, in this embodiment, the integration of the bearing holder (35) and the hydraulic cylinder (87) eliminates the need for mounting the separate hydraulic cylinder (87) to the bearing holder (35). Further, the portion constituting the cylinder tube (81) of the hydraulic cylinder (87) may also be used as the guide surface (37) for the sliding movement of the slide valve (70). This enables the total length of the portion constituted by the bearing holder (35) and the hydraulic cylinder (87) to be designed smaller than that of the known structure, even if the stroke of the slide valve (70) is lengthened. As a result, the total length of the screw compressor may be reduced, which enables a decrease not only in the size and weight of the screw compressor, but also in the wasted space in the bearing holder.

In particular, in the case of a large screw compressor, a decrease in the total length and the resultant decrease in the weight lead to a significant decrease in the amount of materials to be used, and consequently, a significant reduction in the costs. In general, the bearing holder (35) and the cylinder tube (81) are each made of a casting. If these were separate parts, the number of the separate casting parts and the costs would increase. By contrast, according to this embodiment, these parts are integrated in a single part, which also contributes to the reduction in the costs.

Moreover, according to this embodiment, provision of the low-pressure communication passage (60) through which the bearing chamber (C1) and the low-pressure space (S1) of the casing (10) communicate with each other allows the bearing chamber (C1) to be constantly kept at a low pressure, and a thrust load applied to the bearing (36) is reduced. This may retard damage to the bearing (36).

Furthermore, according to this embodiment, the shim plates (95) are used to adjust the position of the bearing holder (35), which also enables adjustment of the position of the screw rotor (40) that is adjacent to the bearing holder (35). As a result, reliable positioning of the screw rotor (40) may be achieved with respect to the gate rotors (50). That is to say, in the configuration in which the cylinder tube (81) is integral with the bearing holder (35), a structure for adjusting the position of the screw rotor (40) may be achieved easily. In this embodiment, the plurality of arc-shaped shim plates (95) may be fitted, radially inwardly, between the fixing portion (39) of the bearing holder (35) and the casing (10). This may facilitate positioning of the bearing holder (35) and the screw rotor (40) when the bearing holder (35) and the screw rotor (40) are mounted in the casing (10).

Moreover, the oil supply passage (65) may be connected easily and reliably at the boundary between the casing (10) and the fixing portion (39) with the passage connecting member. That is to say, in the configuration in which the cylinder tube (81) is integral with the bearing holder (35), the oil supply passage (65) may be provided with a simple configuration. Further, the O-rings may reliably prevent the oil from leaking between the passage connecting member (68) and the casing (10) and between the passage connecting member (68) and the fixing portion (39). A configuration for supplying the oil to the cylinder chamber (C2) may be put to practical use, using the end plate (88).

<<Other Embodiments>>

The above embodiment may also have the following structures.

For example, the present invention is applicable not only to the screw compressor (1) in which the slide valves (70) are used for the unload mechanism (70, 80) for regulating the capacity, but also to a screw compressor in which slide valves are used for a volume ratio regulation mechanism (not shown) for regulating a ratio between a suction volume and a discharge volume (a volume ratio).

In the embodiment described above, the partition plate (38) to separate the bearing chamber (C1) from the cylinder chamber (C2) is provided in the bearing holder (35). However, the partition plate (38) does not necessarily have to be provided. In the case where the partition plate is omitted, it is suitable to use, as the bearing, a thrust bearing which receives a thrust load generated by the pressure in the cylinder chamber (C2).

In the embodiment described above, the bearing holder (35) with which the cylinder tube (81) is integrated has the fixing portion (39) for being fixed to the casing (10). However, the structure for fixing the bearing holder (35) to the casing (10) may be appropriately modified. Also, the oil supply passage (65) is not limited to the structure described in the above embodiment, and may be modified appropriately as long as the oil supply passage (65) enables supply of the oil to the bearing chamber (C1) and the cylinder chamber (C2).

Note that the foregoing description of the embodiment is a merely beneficial example in nature, and is not intended to limit the scope, application, or uses of the present disclosure.

INDUSTRIAL APPLICABILITY

As can be seen from the foregoing description, the present invention is useful as a structure which guides a sliding movement of a slide valve of a screw compressor.

What is claimed is:

1. A screw compressor comprising:

a casing;

a drive shaft having one end supported, via a bearing, on a bearing holder held by the casing, and an other end coupled to an electric motor;

a screw rotor coupled to the drive shaft;

a gate rotor defining a compression chamber in the casing by meshing with a helical groove formed on the screw rotor;

a slide valve slidable in an axial direction of the screw rotor and capable of regulating an area of a discharge opening of the compression chamber; and a slide valve driving mechanism including a hydropneumatic cylinder configured to drive the slide valve, the hydropneumatic cylinder being located opposite to the screw rotor with respect to the bearing interposed therebetween, the bearing holder having an outer peripheral surface configured as a guide surface guiding a sliding movement of the slide valve, the bearing holder and the hydropneumatics cylinder being formed as one piece, and the bearing holder having axial end portions, with one of the axial end portions located opposite to the screw rotor constituting a cylinder tube of the hydropneumatic cylinder, thereby achieving integration of the bearing holder and the hydropneumatic cylinder.

2. A screw compressor comprising:

a casing;

a drive shaft having one end supported, via a bearing, on a bearing holder held by the casing, and an other end coupled to an electric motor;

a screw rotor coupled to the drive shaft;

a gate rotor defining a compression chamber in the casing by meshing with a helical groove formed on the screw rotor;

a slide valve slidable in an axial direction of the screw rotor and capable of regulating an area of a discharge opening of the compression chamber; and a slide valve driving mechanism including a hydropneumatic cylinder configured to drive the slide valve, the hydropneumatic cylinder being located opposite to the screw rotor with respect to the bearing interposed therebetween, the bearing holder having an outer peripheral surface configured as a guide surface guiding a sliding movement of the slide valve, the bearing holder having axial end portions, with one of the axial end portions located opposite to the screw rotor constituting a cylinder tube of the hydropneumatic cylinder, thereby achieving integration of the bearing holder and the hydropneumatic cylinder, in the bearing holder, a partition plate being provided to separate a bearing chamber where the bearing is held, from a cylinder chamber where a piston of the hydropneumatic cylinder is housed, and a low-pressure communication passage through which a low-pressure space provided in the casing communicates with the bearing chamber extending in the casing and the bearing holder.

3. The screw compressor of claim 2, wherein the bearing holder has, on an outer periphery of an end portion thereof adjacent to the cylinder tube, a fixing portion which projects radially outwardly and via which the bearing holder is fixed to the casing, and a shim plate arranged to adjust an axial position of the bearing holder is fitted between the fixing portion and the casing.

4. The screw compressor of claim 3, wherein the shim plate includes an arc-shaped shim plate which is one of multiple pieces prepared by dividing, in a circumferential direction, a ring-shaped position adjusting member fitting on the outer periphery of the bearing holder.

5. The screw compressor of claim 4, wherein an oil supply passage through which a hydraulic oil is supplied to the hydropneumatic cylinder extends from a portion of the casing to a portion of the fixing portion, and the oil supply passage is provided with a passage connecting member which has a tube shape and is fitted to the casing and the fixing portion at a boundary between the casing and the fixing portion.

6. The screw compressor of claim 5, wherein an O-ring is fitted between the passage connecting member and the casing, and another O-ring is fitted between the passage connecting member and the fixing portion.

7. The screw compressor of claim 5, wherein an end plate is provided as a member to block an opening end, of the bearing holder, adjacent to the cylinder tube, and part of the oil supply passage extends in the end plate.

8. The screw compressor of claim 3, wherein an oil supply passage through which a hydraulic oil is supplied to the hydropneumatic cylinder extends from a portion of the casing to a portion of the fixing portion, and the oil supply passage is provided with a passage connecting member which has a tube shape and is fitted to the casing and the fixing portion at a boundary between the casing and the fixing portion.

9. The screw compressor of claim 8, wherein an O-ring is fitted between the passage connecting member and the casing, and another O-ring is fitted between the passage connecting member and the fixing portion.

10. The screw compressor of claim 8, wherein an end plate is provided as a member to block an opening end, of the bearing holder, adjacent to the cylinder tube, and part of the oil supply passage extends in the end plate.

11. A screw compressor comprising:

a casing;

a drive shaft having one end supported, via a bearing, on a bearing holder held by the casing, and an other end coupled to an electric motor;

a screw rotor coupled to the drive shaft;

a gate rotor defining a compression chamber in the casing by meshing with a helical groove formed on the screw rotor;

a slide valve slidable in an axial direction of the screw rotor and capable of regulating an area of a discharge opening of the compression chamber; and a slide valve driving mechanism including a hydropneumatic cylinder configured to drive the slide valve, the hydropneumatic cylinder being located opposite to the screw rotor with respect to the bearing interposed therebetween, the bearing holder having an outer peripheral surface configured as a guide surface guiding a sliding movement of the slide valve, the bearing holder having axial end portions, with one of the axial end portions located opposite to the screw rotor constituting a cylinder tube of the hydropneumatic cylinder, thereby achieving integration of the bearing holder and the hydropneumatic cylinder, the bearing holder having, on an outer periphery of an end portion thereof adjacent to the cylinder tube, a fixing portion which projects radially outwardly and via which the bearing holder is fixed to the casing, and a shim plate arranged to adjust an axial position of the bearing holder being fitted between the fixing portion and the casing.

12. The screw compressor of claim 11, wherein the shim plate includes an arc-shaped shim plate which is one of multiple pieces prepared by dividing, in a circumferential direction, a ring-shaped position adjusting member fitting on the outer periphery of the bearing holder.

13. The screw compressor of claim 12, wherein an oil supply passage through which a hydraulic oil is supplied to the hydropneumatic cylinder extends from a portion of the casing to a portion of the fixing portion, and the oil supply passage is provided with a passage connecting member which has a tube shape and is fitted to the casing and the fixing portion at a boundary between the casing and the fixing portion.

14. The screw compressor of claim 13, wherein an O-ring is fitted between the passage connecting member and the casing, and another O-ring is fitted between the passage connecting member and the fixing portion.

15. The screw compressor of claim 13, wherein an end plate is provided as a member to block an opening end, of the bearing holder adjacent to the cylinder tube, and part of the oil supply passage extends in the end plate.

16. The screw compressor of claim 11, wherein an oil supply passage through which a hydraulic oil is supplied to the hydropneumatic cylinder extends from a portion of the casing to a portion of the fixing portion, and the oil supply passage is provided with a passage connecting member, which has a tube shape and is fitted to the casing and the fixing portion at a boundary between the casing and the fixing portion.

17. The screw compressor of claim 16, wherein an O-ring is fitted between the passage connecting member and the casing, and another O-ring is fitted between the passage connecting member and the fixing portion.

18. The screw compressor of claim 17, wherein an end plate is provided as a member to block an opening end, of the bearing holder, adjacent to the cylinder tube, and part of the oil supply passage extends in the end plate.

19. The screw compressor of claim 16, wherein an end plate is provided as a member to block an opening end, of the bearing holder, adjacent to the cylinder tube, and part of the oil supply passage extends in the end plate.

* * * * *